United States Patent [19]

Tourville et al.

[11] Patent Number: 4,570,939

[45] Date of Patent: Feb. 18, 1986

[54] BOARD GAME

[76] Inventors: David A. Tourville, 282 E. Wyoming, St. Paul, Minn. 55107; Charles D. Borden, 1891 Grand Ave., St. Paul, Minn. 55104

[21] Appl. No.: 553,965

[22] Filed: Nov. 21, 1983

[51] Int. Cl.[4] ..... A63F 3/04

[52] U.S. Cl. ..... 273/253

[58] Field of Search ..... 273/250, 253, 254

[56] References Cited

U.S. PATENT DOCUMENTS

| | | | |
|---|---|---|---|
| 3,556,528 | 1/1971 | Spiring | 273/254 |
| 3,973,775 | 8/1976 | Bolan et al. | 273/253 |
| 4,010,954 | 3/1977 | Uding | 273/253 X |
| 4,093,235 | 6/1978 | Barry | 273/254 |
| 4,114,891 | 9/1978 | Lawrimore | 273/250 |
| 4,157,184 | 6/1979 | Recard, Jr. | 273/253 |
| 4,385,765 | 5/1983 | Munn et al. | 273/253 |

FOREIGN PATENT DOCUMENTS

| | | | |
|---|---|---|---|
| 2224988 | 10/1974 | France | 273/254 |

OTHER PUBLICATIONS

"Stellar Conquest" Games Master Catalog, p. 38, ©1980.

*Primary Examiner*—Richard C. Pinkham
*Assistant Examiner*—Scott L. Brown
*Attorney, Agent, or Firm*—Thomas B. Tate

[57] ABSTRACT

A board game combining finance, military skill and strategy. An outer peripheral financial path encloses an inner military pathway which represents the sun and the orbits of the planets around the sun. Planetary pathways are positioned between the financial pathway and the military pathway. Each planetary pathway has planet sections which may be purchased and used as sites for launching spaceships. The players move their playing pieces over the board acquiring industries and the planets and launch ships to make military conquests and eventually conquer the entire solar system.

1 Claim, 7 Drawing Figures

BOARD GAME

BACKGROUND AND SUMMARY OF THE INVENTION

Board games involving acquisition of property and similar financial strategy are well-known in the art. Board games involving military strategy, including those having an interplanetary warfare theme, are likewise well-known in the art.

The present invention, however, combines elements of both financial and military games in such a manner as to produce a game requiring a unique blend of strategic skills.

The object of the game is to purchase industries, then to purchase planets, launch ships to make military conquests of other players' planets, and eventually conquer the entire solar system.

DESCRIPTION OF VIEWS OF THE DRAWING

Because the game board is too large to be shown conveniently on one sheet, it has been divided into four quadrants for purposes of illustration.

DESCRIPTION OF THE PREFERRED EMBODIMENT OF THE INVENTION

Figure 1:
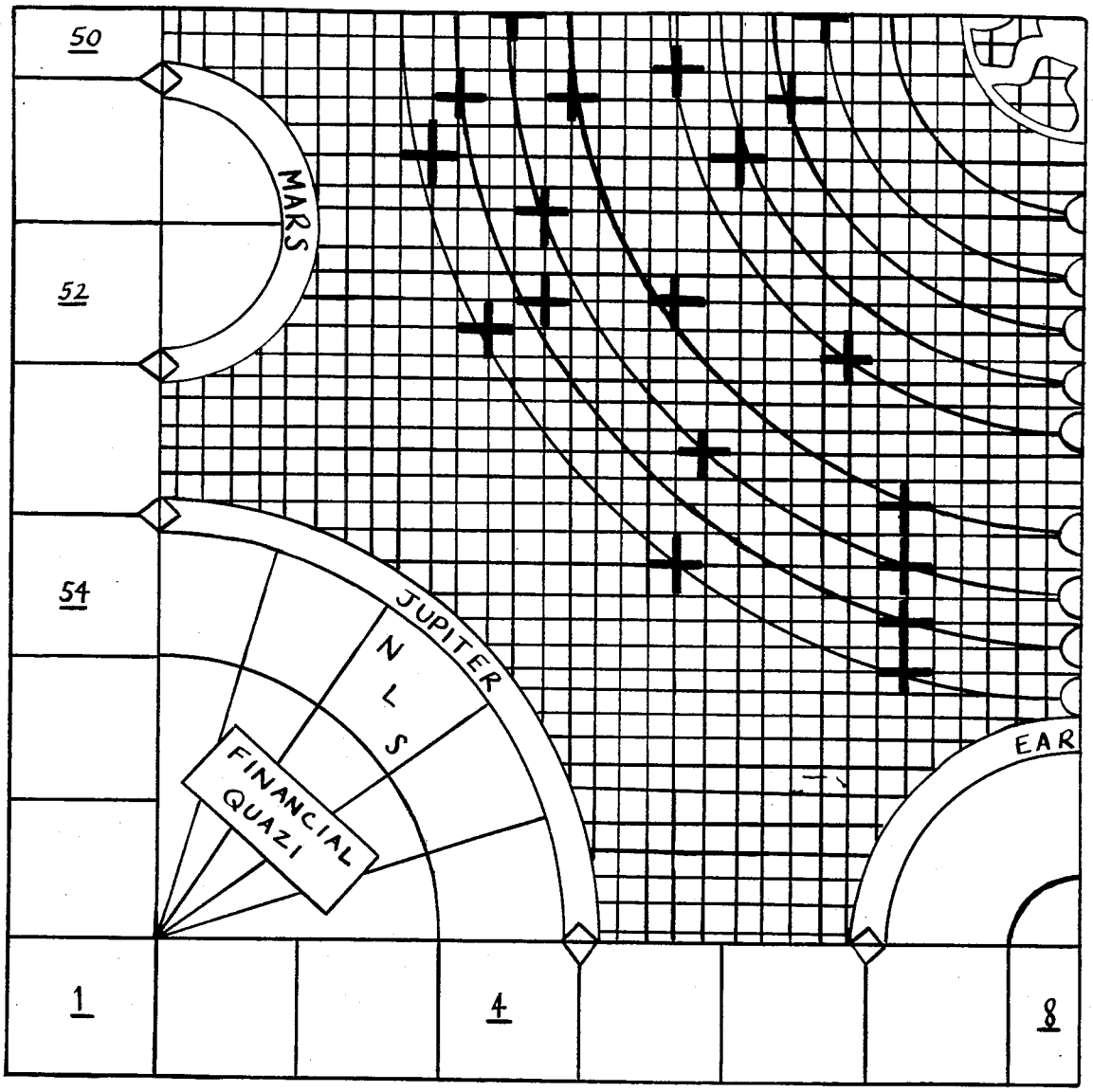
FIG. 1 is the lower left quadrant.
Figure 2:
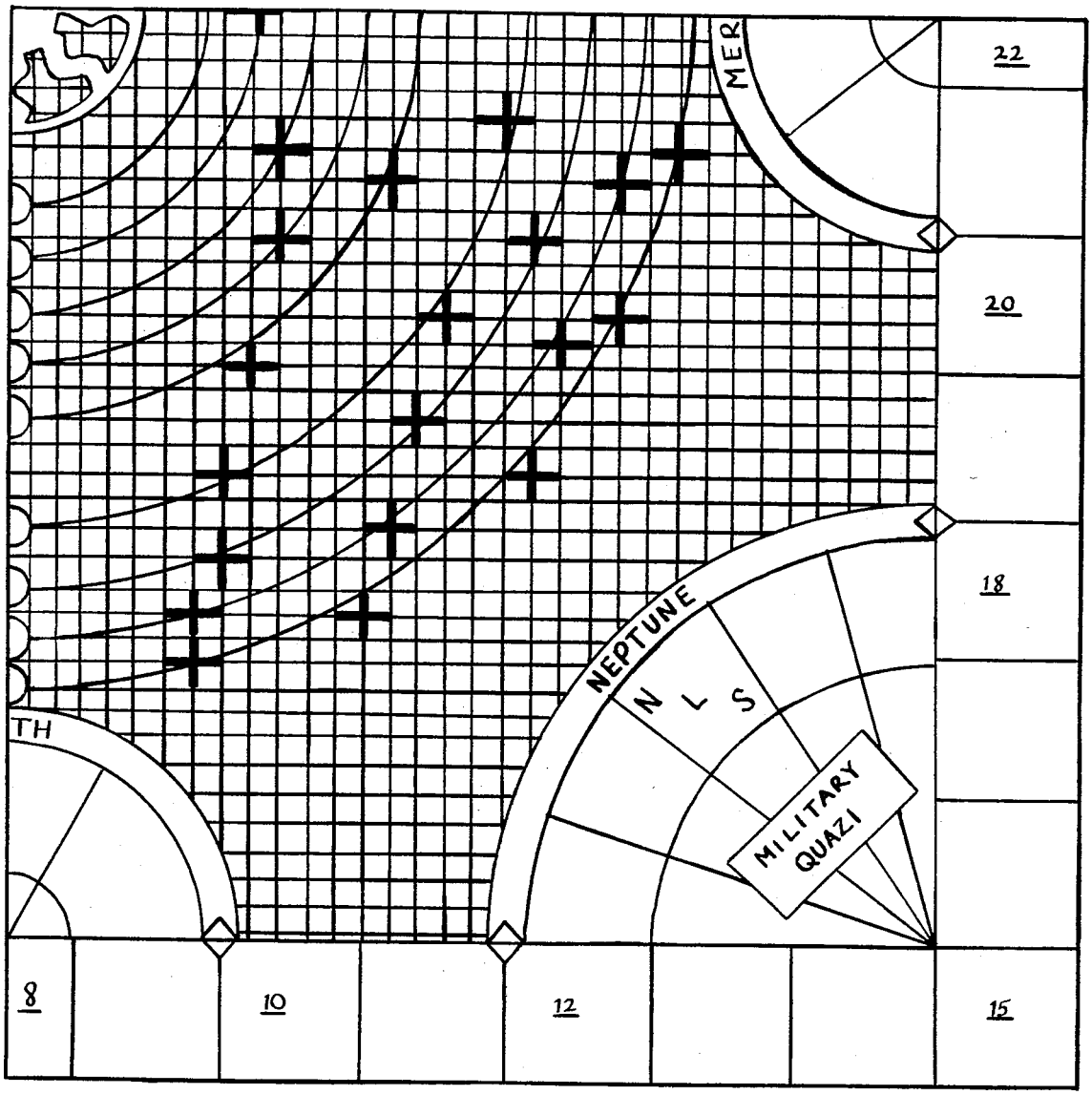
FIG. 2 is the lower right quadrant.
Figure 3:
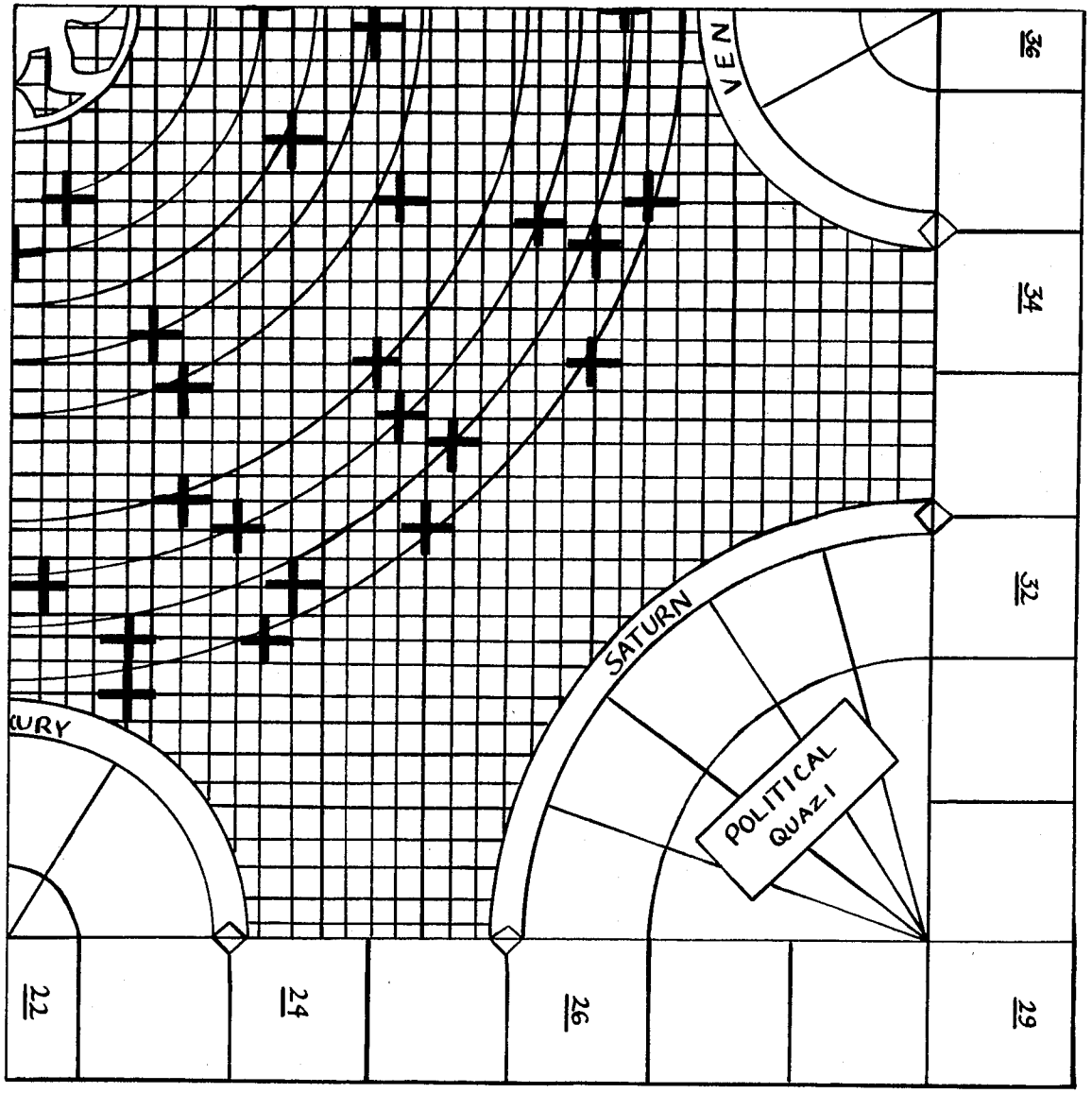
FIG. 3 is the upper right quadrant.
Figure 4:
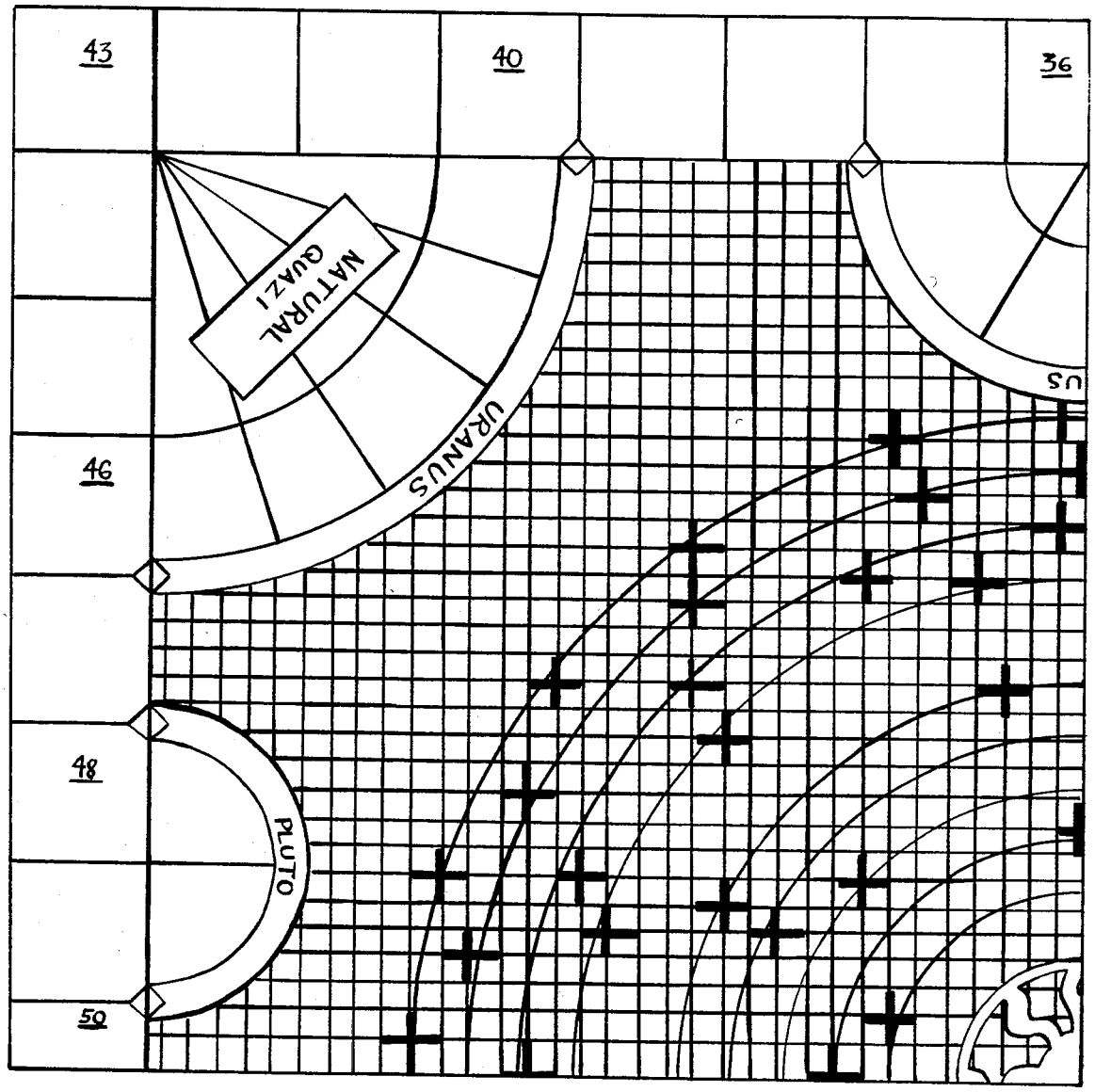
FIG. 4 is the upper left quadrant. When the four sheets are placed next to each other in that arrangement, they form a complete figure, showing a top view of the game board.

The invention is a financial-military board game called "Quazi."

The game board, as shown in the drawings, comprises an outer financial pathway, an inner military pathway, and a plurality of planetary pathways linking said financial pathway to said military pathway.

The financial pathway comprises the fifty-six squares around the edges of the game board. Eight of these squares are quazi card squares. A player landing on one of these squares has the option to draw a card from the corresponding quazi card deck. Squares 1 and 36 are financial quazi, squares 8 and 29 are political quazi, squares 15 and 50 are military quazi, and squares 22 and 43 are natural quazi. Fourteen of the squares are control squares, some of which have special effects which will be explained later by reference to the rules. These are squares 20 and 48 (Earth Casino), square 4 (Time Warp), square 12 (Quazi Reverse), square 18 (Receive political favor), square 26 (Planetor's Square), square 32 (Space Vacation), square 34 (Planetary Revolt), and square 40 (Identity Crisis). The other control squares are square 10 (inherit $1000 from Uncle Mole), square 24 (new engine developed-advance two times sum of dice), square 26 (discover Mars dust-collect $500), square 52 (solar flare-end turn), and square 54 (engine failure-return to last square). The remaining thirty-four squares in the financial pathway are purchasable industries, each of which has a specified cost and rent.

The military pathway comprises the Sun in the center of the game board and the nine planets (Mercury, Venus, Earth, Mars, Jupiter, Saturn, Uranus, Neptune, and Pluto), with their respective orbits around the Sun. Planet game markers are moved along the course of these orbits during the play of the game. The crosses along each orbit mark possible positions of the planets.

The nine planetary pathways adjacent to the financial pathway are the link between the financial pathway and the military pathway. Each of these nine planetary pathways corresponds to a planet shown on the inner military pathway. Each of said planetary pathways is divided into sections. Mars and Pluto each have two sections, Mercury, Venus, and Earth each have three sections, and Jupiter, Saturn, Uranus, and Neptune each have five sections, the central section being a Neutral Launch Site (NLS). Each of the latter four planetary pathways also has a square upon which is placed one of the Quazi card decks.

Additional game equipment includes a plurality of game markers, each type of which has a different shape to distinguish it from other types of markers (for example, in the prototype of the game, personal markers are pyramids, ownership markers are pentagons, ship markers are triangles, space mines are crosses, and planet markers are coin-shaped); chance means, such as dice, for determining the movement of said markers along said pathways; indicia, such as the Quazi cards, giving instructions relating to the play of the game; and means, such as a supply of play money in various denominations, for determining the relative wealth of the players.

The play of the game will best be understood by reference to the rules of "Quazi," which are incorporated into this application. These rules, however, are offered only for purposes of illustration, not by way of limitation, and it is intended that the scope of this invention include all modifications of this game which do not depart from the spirit of the invention.

The rules of "Quazi" are as follows:

INTRODUCTION

Quazi is a game of skill and strategy played by two to six players for two to five hours. Players should be ten or older. Quazi players enjoy its realistic combination of Financial and Military Games.

OBJECT

Players travel the financial outside board buying industries which pay rents and dividends. After buying the required amount of industries, players turn into and buy planet sections. Players launch ships from any of their planet sections, and make military conquests of other planet sections, until all players concede to one winner.

THE OUTSIDE BOARD

The QUAZI BOARD is largely self-explanatory. Each side has fifteen squares, totaling fifty-six squares on the outside board.

1. BLUE squares are PURCHASABLE INDUSTRIES: earning the players income through rents and dividends.

2. BLACK squares are QUAZI CARD SQUARES: giving the player the option to draw, or not draw QUAZI CARD from that deck.

3. RED squares are CONTROL SQUARES: adding unusual twists, to a game relying mostly on skill and strategy.

THE MISSING LINK

The union of the outside financial board and the inside military board is possible through the planets. Planets are the semi-circular groups of squares along the edges of the inside board. When turning through planets, players count through the semi-circle, and continue back onto the outside board. Planets offer players alternate routes around the board. Each semi-circular group of squares is only a purchasable representation of a planet. Actual location of each planet is shown on solar map of inside board.

THE INSIDE BOARD

The inside board is a map of our solar system with nine colored circles encompassing the sun. Each circle represents a planets orbit. Each orbit has a start position and orbital path. This is the Military Board.

GAME PROGRESSION

1. Players buy industries.
2. Players buy planets.
3. Players buy and launch ships, then land and purchase unoccupied sections.
4. Players attack each others property with space ships.
5. After first ship is purchased, PLANETOR ADVANCES planets once after his every turn.
6. Players battle for solar dominance, while playing the outside board.
7. Using strategy, one player eventually conquers the solar system.

START

Players select boxes of pieces. Players place personal markers on corner financial quazi.

ELECTING BANKER

Each player rolls a die to elect a banker who is responsible for all financial transactions.

1. Banker takes the four quazi card decks, shuffles them, and places them on the spots provided.
2. Banker deals starting money as shown below.
   Two players: 1200 each
   Three players: 1300 each
   Four players: 1400 each
   Five players: 1500 each
   Six players: 1600 each

ELECTING PLANETOR

Remaining players roll dice to elect Planetor. Planetor keeps the planets advanced in their orbits. Planetors sets up the coin shaped planet markers in start Positions. Each planet marker is color coded to match its orbit. The planets name appears on front, and the number in back shows its orbital rank from the sun.

PLANETOR

Planetor places planet markers on start positions. Whenever planetor passes or lands on Planetors square, he moves each planet up one space in its orbital path. He does not move planets until after his turn is over.

After first ship is purchased, planetor advances planets after his every turn, til end of the game. If planetor is forced out of the game by Bankruptcy, all players but Banker re-roll to elect new planetor.

FIRST MOVES

Banker goes first, by rolling the three dice, and advancing the total amount shown counterclockwise. He follows directions on square. If he lands on one of the Blue industries, he should buy it by paying purchase price to bank, and placing Ownership marker. When player owns enough industries, he begins *calling, turning* into, and *buying* planets. Anytime player lands on another players industry or planet, he pays rent to owner. When Banker completes turn, play passes to person on Banker's right.

PROGRESSION OF TURN

1. Before rolling, Players may sell on properties back to bank for purchase price.
2. If player wishes to turn into a planet, he must call planet before rolling dice.
3. Player rolls all three dice, and advances amount shown.
4. Player follows instructions on square, takes care of business like buying, paying or collecting.
5. Player takes military turn. (Explained later)

CONTROL SQUARES

The fourteen red control squares are self explanatory, the following have special effects:

EARTH CASINO: gives player a chance to earn as much money as he is willing to risk. Players landing on EARTH CASINO, may bet any amount of their cash against a roll of the dice: This may be done in two ways. Player may bet two to one odds, by placing his bet, calling high or low, and rolling the dice. Numbers 1,2,3, are low, and numbers 4,5,6, are high. If a player places a $100.00 bet on low, and wins the roll, the player keeps the original $100.00, and takes $100.00 from the bank. Another bet is with six to one odds, by placing bet and calling an exact number. Winners collect six times the amount bet from bank. Losers pay amount bet to bank.

RECEIVE POLITICAL FAVOR: gives an extra turn. The player completes his turn and takes another turn. This square can help you Militarily.

PLANETORS SQUARE: the Planetor advances planets everytime he passes or lands on the planetors square, until a ship is launched. Thereafter, he moves the planets after his every turn. Other players who land on the planetors square, follow the squares directions, and continue turn.

SPACE VACATION: Players landing on space vacation move again by multiplying the sum of the Red dice, times the amount of the White dice. Player advances and continues turn as usual.

PLANETARY REVOLT: ends players turn immediately for two turns. Player may not collect rents or make ship manuevers. If the player's ships or bases are attached, he may retaliate by firing all shots in range on the attacker. He does this immediately after attackers military turn.

TIME WARP: Time Warp erases any Planetary revolt or prison sentences. It does not effect quazi reverse.

IDENTITY CRISIS: Players reroll for game character and banker goes first. Game continues as normal.

QUAZI REVERSE: Players landing on Quazi Reverse move personal marker in opposite direction starting next turn.

QUAZI CARD SQUARES

At evenly split spaces around the board, players encounter Quazi Squares. Each square has its corresponding Quazi deck. Each deck contains good and bad effects. Quazi players have the option to draw or not draw the card, with the foreknowledge that each deck has eight good and five bad cards. Military and Natural Quazi cards deal with the inside board, and players *may not draw cards* from them unless they have ships. Player decides immediately, and finishes turn as usual.

FINANCIAL QUAZI

Players passing or landing on either financial quazi, collect the amount below from bank.

Two players: $200.00
Three players: $300.00
Four players: $400.00
Five players: $500.00
Six players: $600.00

In addition players collect $50.00 for each industry, and $100.00 for each planet section owned when passing financial quazi. If player owns an entire planet, its dividend value doubles. If a player forgets to collect his money, he loses it.

BANKRUPTCY

Players may sell any industry or planet section, the bank will repay purchase price. All transactions are completed before rolling dice. If a player cannot pay a rent or fine of a square he lands on with his immediate cash, he is bankrupt and out of the game. Debtee takes remaining immediate cash, but all other assets are returned to bank for resale.

BUYING PLANET SECTIONS

1. Before buying planet sections the players must own a certain number of industries; two players—five industries, three players—four industries, four players—three industries, five players—two industries and six players—two industries.
2. When a player owns the required amount of industries, he begins turning into the planets. Players must call the planet before rolling dice.
3. Players who land on an unowned planet section may buy the section by paying the purchase price, and putting ownership marker on it. Players landing on other players sections, pay rent to owner.

BUYING SHIPS

Once a player buys his first planet section, he may buy ships for $1,000.00 each. Ships can be placed at any of its owners planet sections.

NEUTRAL LAUNCH SITES

Each corner planet is up into 5 squares. Four squares are the planet's color and the Black squares are called Neutral Launch Sites, (NLS). Players pay a $250.00 fee per ship launched. Players must land on Neutral Launch Sites to use them. This square is rent free and cannot be used.

LAUNCHING SHIPS

Player launches each ship by rolling the white military die. He moves ship that amount of squares in any direction from the planet.

CLAIMING UNOWNED PLANETS

To claim an unowned planet, player lands on it, pays the purchase price, and puts ownership marker on it. Players may launch off their planet, and land on another planet in the same turn, if roll is large enough. Players may not launch off of a planet and land back on the same planet in the same turn.

ATTACKING ENEMY SECTIONS

As game progresses, players need to conquer enemy owned planets sections to complete solar dominance. Player maneuvers ship into the six square firing range, by rolling the white die, then rolls again to fire on the enemy section base. All ships and planet sections have one shot per turn. The shots are fired by rolling one die, the shot is a hit if the attackers die beats the defenders die. If player hits an enemy section, the enemy loses the section, and returns ownership marker to box. If the defender wins roll, the shot is a miss, and attacker loses nothing. Players attack only during their own military turns from space. Players who conquer enemy sections can take possession by landing, and placing ownership marker. If player doesn't land within one turn of bases defeat, he must pay purchase price.

SHIP TO SHIP FIGHTING

Ships have two military uses, moving and firing. The player will always fire and move out of range if possible. To attack another ship, player must maneuver his ship within a SIX square firing range. Then, player may fire his shots on the ship by rolling die once, for each of his ships within range. If attackers roll beats defenders roll, ship is destroyed, and he returns it to box. If defenders roll equals or beats attackers roll, he loses nothing.

PLANET FIRING

Players may fire one shot from each planet section having a ship within range. Sections may fire at other sections. Players use same die rules that apply to ship firing.

SPACE MINES

Players may launch space mines to defending a planet from a fleet. Players attacking a target defended by space mines, must go around the mines, or destroy a mine and fly through the gap created. Player buys mines for $300.00 from bank, and launches from any of his planet sections. Player has one roll of die to launch each space mine. Once a player has moved his space mine, it is permanent. The mines have a destruction radius of one square around itself. Ships coming within range are destroyed along with mine. Any ship or section may fire shots on mines. Mine owner rolls defending die, and one hit destroys mine.

END OF THE GAME

Game ends when any player owns half or more of all nine planets. Players may concede. The game changes suddenly, and a player shouldn't conceed until his opponent has everything sewn up tight.

SPECIAL RULES

1. Anytime a planet moves over a square occupied by a ship, that ship is destroyed, and the owner must return that piece to the box.
2. No player may fly his ship through the sun or the yellow area around the sun, or his ship is destroyed.
3. If any player draws the planetary line-up card from the natural quazi deck, the planetor must return all planets to their start positions on the inside board. All players return their personal markers to the corner financial quazi square on the outside board.

4. Anytime a player lands on NEW ENGINE DEVELOPED and it leads to ENGINE FAILURE, advance to Time Warp, and its rules apply.
5. Rolling 3 of a kind lets the player advance from his square by space vacation rules.
6. Players may start game on either financial quazi square.

SHORT GAME

A normal quazi game ends when any one player owns half or more of each of the nine planets. To shorten the game, players can by-pass planet *sections.* When a player lands on any planet section he pays the purchase price and becomes owner of the entire planet. Game ends when one player owns all nine planets. Players must still count out planet sections when turning through any planet.

REFLECTORS

Reflectors cost $1,000.00, and launch from any of a players planet sections into space with the 20 sided dice. Reflectors are indestructible, unless hit by a planet. Any base or ship within six spaces of a reflector can fire its shots through the reflector and have its range increased. Range is increased 2 times the distance between the reflector and the guns firing through it. The reflector increases range in a circle around itself evenly, with the attacker rolling a dice against the defender, and defender taking ties. Reflectors can be moved only once, and cannot be used until one turn after launch.

ARMYS

Players who wish to attack a planet section without using a ship, or entering space, may purchase armys. Armys cost $1,000.00, and launch from either military quazi onto the outside board, with the 20 sided dice. They move in either direction around the board, but must turn through a planet to change direction. Armys do not affect personnal markers, and are not affected by squares that they land on. They do not function until they are on a square next to an enemy planet section. The army owner rolls dice against planet section owner for possession of the section. Tie dice are rerolled, and if attacker wins, he owns the section. If defender wins roll, the army is destroyed. Armys cannot pass over enemy planet sections or neutral launch sites. Armys do not need an exact number to land on any square, they need only get rolls large enough to get them to the desired target planet. If army is on a planet section when its base is destroyed from space, the army is destroyed.

ORBIT ADVANCE CHIPS

The planetor gives orbit advance chips whenever a player draws either a natural or military quazi card. When a player has two chips, he may cash them into the planetor, who must move all planets one space in either direction according to the players wishes. Chips are used at any time during a players military turn.

KIDNAPPERS

Players who wish to cause another player to lose two turns may hire kidnappers. Kidnappers cost $1,500.00, and launch from any of a players planet sections onto the outside board as a military move. They move using the 20 sided dice going Counterclockwise and have two turns to capture an opponents personal marker. After two turns, Kidnapper is returned to box. When player is caught by Kidnapper, he moves his personal marker to planetary revolt, and its rules apply. Players may turn into planets, where Kidnappers may not.

SPECIAL RULES

Whenever a players personal marker is on a base that is destroyed, his marker is moved to planetary revolt and he follows its directions.

We claim:

1. A board game combining financial and military skill and strategy, said game comprising:
   - a game board having an outer financial pathway, an inner military pathway, and a plurality of planetary pathways linking said financial pathway to said military pathway;
   - said financial pathway comprising a plurality of squares representing industries which may be purchased and owned by players, and a plurality of other squares giving, directly or indirectly, instructions relating to the play of the game;
   - said military pathway comprising a representation of the Sun and the planets of the solar system, and the respective orbits of each of said planets around said Sun;
   - said planetary pathways comprising representations of the planets separate and distinct from the aforementioned representations of the planets in said military pathway, said planetary pathways being positioned between said financial pathway and said military pathway, each of said planets in said planetary pathways comprising sections which may be purchased and owned by players and which may be used as launching sites for spaceships;
   - game markers for indicating movement of players along said pathways;
   - game markers of a different shape for indicating ownership of said industries or said planet sections;
   - game markers of a still different shape, to be used as planetary markers, said markers allowing each of said planets in said military pathway to move to different positions in its respective orbit, by moving said markers along each of said orbits;
   - game markers of still different shapes, representing military equipment;
   - chance means for determining the movement of said game markers;
   - indicia giving instructions relating to the play of the game;
   - means for determining the relative wealth of the players;
   - the object of said game being to conquer the solar system by the following means:
   - moving along said financial pathway to acquire industries thereon and thus generate income;
   - using said income to purchase planets, or sections thereof, on said planetary pathways;
   - purchasing and launching spaceships from said planet sections to make military conquests of planet sections owned by other players;
   - the winner being the player who succeeds in conquering the entire solar system or an agreed upon portion thereof.

* * * * *

UNITED STATES PATENT AND TRADEMARK OFFICE

CERTIFICATE OF CORRECTION

PATENT NO. : 4,570,939 Page 1 of 2

DATED : February 18, 1986

INVENTOR(S) : David A. Tourville et al.

Figure 5:
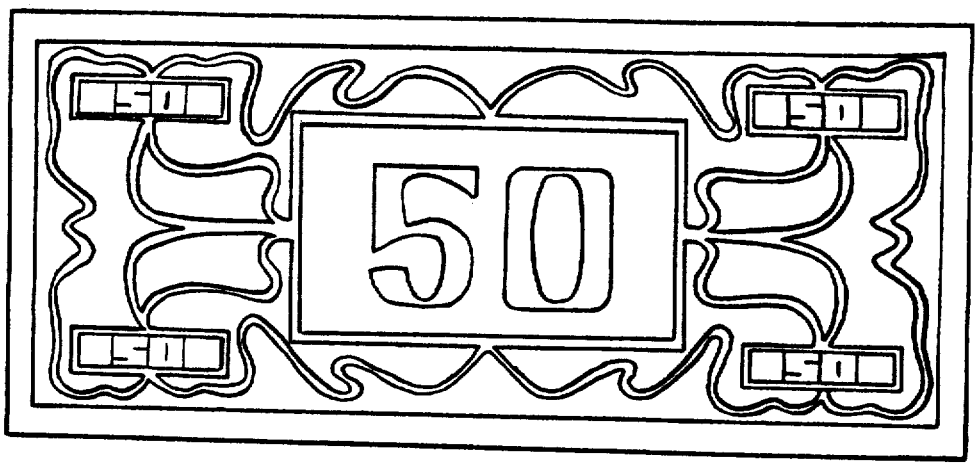
FIG. 5 is an example of the play money used in the game.
Figure 6:
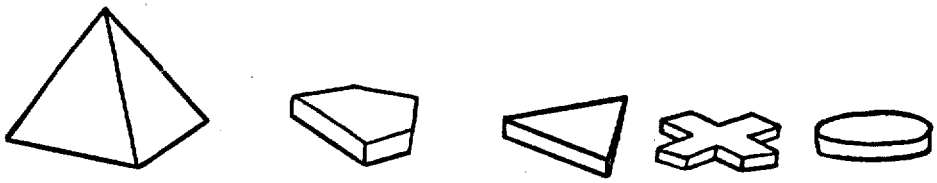
FIG. 6 shows examples of several types of game markers.
Figure 7:
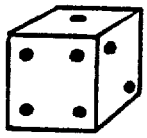
FIG. 7 shows a die which is used as a chance means to determine movement of the game markers.

It is certified that error appears in the above-identified patent and that said Letters Patent is hereby corrected as shown below:

In the drawings Figures 5, 6 and 7, should be added as per attached sheet.

Column 5, line 60, "cannot be used" should read -- cannot be owned --.

Signed and Sealed this

*Nineteenth* Day of *August 1986*

[SEAL]

*Attest:*

DONALD J. QUIGG

*Attesting Officer* *Commissioner of Patents and Trademarks*